US006260784B1

(12) United States Patent
König

(10) Patent No.: US 6,260,784 B1
(45) Date of Patent: Jul. 17, 2001

(54) METHOD OF AND APPARATUS FOR APPLYING A THREAD TO A WINDING SLEEVE

(75) Inventor: Günter König, Uhingen (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/273,917

(22) Filed: Mar. 22, 1999

(30) Foreign Application Priority Data

Mar. 26, 1998 (DE) ..... 198 13 491

(51) Int. Cl.[7] ..... B65H 67/04
(52) U.S. Cl. ..... 242/476.4
(58) Field of Search ..... 242/475.7, 476.3, 242/476.4, 476.5, 476.6

(56) References Cited

U.S. PATENT DOCUMENTS 3,899,140 * 8/1975 Gleyze ..... 242/476.4
4,022,389 * 5/1977 Slavik et al. ..... 242/476.4
4,099,679 * 7/1978 De Baker et al. ..... 242/476.5
4,101,086 * 7/1978 Thomas, Jr. ..... 242/476.5
4,687,148 * 8/1987 Schuller et al. ..... 242/476.3
5,590,844 * 1/1997 Hatakeyama et al. ..... 242/475.7
5,681,000 * 10/1997 Gobbels et al. ..... 242/475.7
5,906,332 * 5/1999 Greis et al. ..... 242/476.4
6,045,081 * 4/2000 Oberstrass et al. ..... 242/473.8

FOREIGN PATENT DOCUMENTS 2 220 977 11/1972 (DE) .
42 33 638 4/1994 (DE) .
0 719 6251 8/1995 (JP) .

* cited by examiner

*Primary Examiner*—Michael R. Mansen
(74) *Attorney, Agent, or Firm*—Herbert Dubno

(57) ABSTRACT

A thread guide engages the thread from a supply qallet to a suction element, while the thread is held by the suction element, to entrain the thread to the thread-capturing slit of a winding sleeve in a winding apparatus, especially a stretch winder. As a result, the thread meets the winding sleeve at a location at which the winding sleeve and the thread are traveling in the same direction.

12 Claims, 5 Drawing Sheets

METHOD OF AND APPARATUS FOR APPLYING A THREAD TO A WINDING SLEEVE

FIELD OF THE INVENTION

My present invention relates to a method of and an apparatus for applying a thread to a driven winding sleeve, especially for a stretch-winding machine in which a thread arriving from a supply gallet or other source of an oncoming thread is engaged by a suction element and the engaged thread is entrained to the thread-capture slit of the winding sleeve and wherein, in the course of this operation, the thread is removed from the suction element.

BACKGROUND OF THE INVENTION

In winding machines a thread, usually assembled from a number of filaments, after stretching or as part of the stretching, can pass around a feed gallet or can be delivered by the feed gallet and pinch rollers, if desired, to a winding sleeve which may be provided along its periphery with a slit in which the oncoming thread can be captured.

In stretch winding machines especially, after the initial processing of the thread, e.g. by stretching after or during heating on one or more gallets or between gallets, for subsequent processing the threads are wound on such winding sleeves generally at a multiplicity of winding stations and usually in a cross winding operation so that successive layers of the winding are pitched in opposite directions. The individual winding units comprise, in addition to the locatable winding sleeve, a friction wheel or roller which is driven and which bears upon the outer periphery of the winding sleeve and the spool or bobbin of thread wound thereon. Other devices at each station can include a changing thread guide for assisting the feed of the thread to a new winding sleeve and a spool or bobbin holder and a spool or bobbin carriage.

The spool or bobbin after the tube has been fully wound with the thread must be exchanged for a winding sleeve adapted to receive the oncoming thread and this replacement or exchange of a full bobbin or spool for a new winding tube can be carried out automatically or manually.

With manual replacement it is necessary to apply the thread to the new winding sleeve and for that purpose a suction device, for example, a suction gun, may be provided which can be operated manually and which engages the thread, and applies it to the winding sleeve. The winding sleeve in turn engages the thread and winds it up in a multiplicity of layers, preferably with cross winding in the manner mentioned above. The winding sleeve, so that it is better able to capture the end of the thread, can have a V-shaped thread capture slit which is usually provided only over part of the periphery of the sleeve at an end portion thereof.

In German patent document DE 22 20 977 A1, a device for manipulating such threads is described which assists the manual introduction of the thread or yarn into the winding machine by feeding it to a yarn carrier which, in turn, transfers the yarn. The thread can then be separated with a cutting element so that waste can be collected by a suction device.

German patent document DE 42 33 638 A1 describes a device for winding up at least one thread in which a winding sleeve is provided with a shoulder of larger diameter. This shoulder is positioned adjacent the friction periphery of a friction wheel and is configured to pick up the starting length of a thread. A thread-guide arrangement is juxtaposed with the winding sleeve and is so oriented and constructed as to feed the thread onto the shoulder into the region of the winding sleeve. Depending upon the characteristics of the thread to be wound up on the sleeve and the design of the thread-processing zone of the machine (usually a stretch-winding machine), the following problems can arise:

(a) possibility of thread breakage between the supply gallet and the winding unit; and (b) loose turns in the thread windings on the winding sleeve, especially in the region of the thread reserve and at least partly in the initial layers of the binder or spool.

As a consequence, an insufficiently secure thread reserve can shift or loosen. The result is a significant quality difference between yarn packages wound with excessively loose portions of the thread or yarn by comparison with normally wound yarn packages.

OBJECTS OF THE INVENTION

It is, therefore, the principal object of the present invention to provide an improved method of applying a thread to a winding sleeve whereby the contrary movements of the thread and the winding sleeve are minimized as much as possible and, in particular, the length of thread for which the sleeve moves in the opposite direction during the capture of the thread is held to a minimum.

Another object is to provide an improved method of applying a thread to a winding sleeve, whereby drawbacks of earlier systems are avoided.

It is also an object of the invention to provide an improved apparatus or device for applying a thread to a winding sleeve which ensures uniform, tight and reproducible formation of spools, bobbins or yarn packages on the winding sleeve.

SUMMARY OF THE INVENTION

These objects and others which will become apparent hereinafter are attained by providing a thread-guide element which engages the thread as it is held by the suction element at a point between the supply gallet and that suction element and which carries the entrained thread to the thread-capture slit at a point at which the direction of travel of the winding sleeve is the same as the travel direction for the delivered thread. The thread is thus engaged in the thread-capture slit and the danger of increased tension resulting in thread breakage or loose winding of the thread is significantly reduced. Thereafter the thread-guide element is returned to its rest or starting position. More particularly, a method of applying a thread to a winding sleeve having a thread-capturing slit in at least part of the periphery thereof, can comprise the steps of:

(a) supplying the thread to the winding sleeve from a location such that the thread, in winding onto the sleeve, lies approximately in a plane substantially tangential to the friction roller and the winding sleeve at the contact line;

(b) holding a free end of the thread with a suction element to form a span of the thread between the location and the suction element; and (c) entraining the thread along the span with a thread-guide element to the thread-capturing slit of the winding sleeve at a quadrant thereof immediately ahead of the contact line in the rotation of the winding sleeve, thereby capturing the thread on the winding sleeve and withdrawing the end from the suction element.

The apparatus can include:

means for supplying the thread to the winding sleeve from a location such that the thread, in winding onto the sleeve, lies approximately in a plane substantially tangential to the friction roller and the winding sleeve at the contact line;

a suction element for holding a free end of the thread to form a span of the thread between the location and the suction element; and a thread-guide element for entraining the thread along the span to the thread-capturing slit of the winding sleeve at a quadrant thereof immediately ahead of the contact line in the rotation of the winding sleeve, thereby capturing the thread on the winding sleeve and withdrawing the end from the suction element.

According to a feature of the invention during application of the thread to the winding sleeve engaged by the friction wheel, the thread is guided through a region of the thread-guide element and is moved with the latter by an adjustment movement to the thread-capture slit of the winding sleeve, whereupon the thread engaged by the sleeve or tube is torn in the region of the suction element. The thread-guide element can have a notch formed in a sheet-metal member constituting the thread-guide element and this sheet-metal thread guide can be guided in a bracket mounted on the cross-winding box or on a rail mounted on the cross-winding box of the apparatus.

According to another feature of the invention, the thread-guide member can be movable vertically from a rest position into a working position and back and can be biased by a spring into the rest position. To ensure a well-defined position of the thread guide in the respective positions, abutments can be provided which fix the rest position and the working position. Customarily, a number of winding stations are provided in a row and, as a consequence, the respective thread guides can be spaced apart along the rail mentioned previously and can be held in respective brackets.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
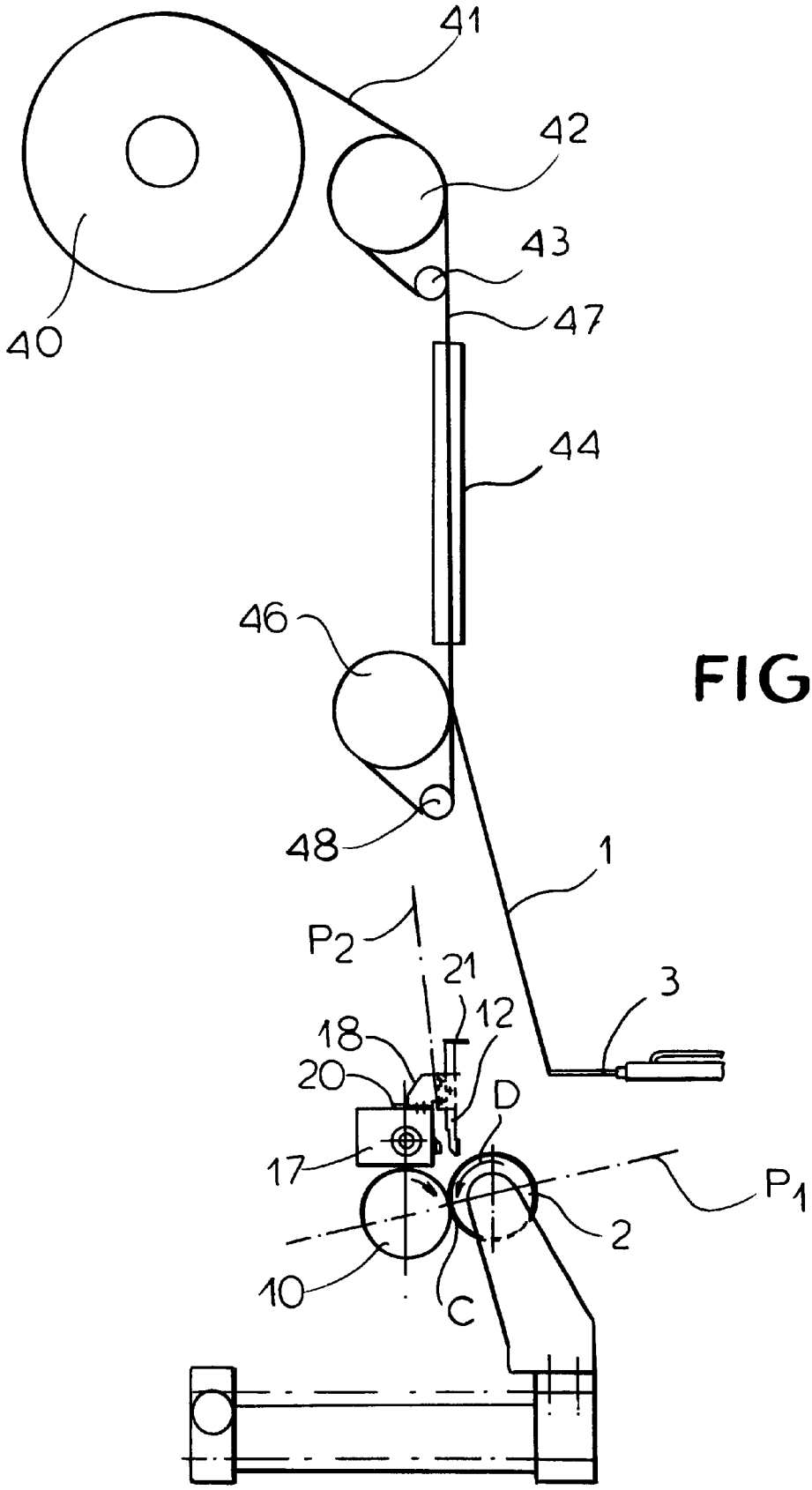
FIG. 1 is a schematic side elevational view of an apparatus according to the invention with the thread guide shown in its rest position and a suction gun shown to have engaged an end of a thread to be applied to a winding sleeve.

FIGS. 1, 3, 4 and 5 show an apparatus for applying a thread 1, i.e. a synthetic filament thread, to a driven winding sleeve in, for example, a stretch-winding machine.

Such a winding machine can comprise, downstream of a source 40 from which the filaments 41 which form the thread 1 derive, by a supply gallet 42. The supply gallet and its auxiliary roller 43 receive a number of turns of the group of filaments 41 which can then be drawn under tension in a stretch 47 while passing a heating unit 44, the tension being applied by a second gallet 46 and its roller 48. The thread 1 can then be applied to the sleeve 2 to be wound in a bobbin or package thereon.

To apply the thread 1 to the winding sleeve 2 which is formed with a thread-capture slit 8, a suction element 3 is provided. After the thread 1 is applied to the winding sleeve 2, the thread is separated from the suction element 3.

According to the invention, a thread-guide element 5 is provided which is used to displace the thread 1, while it is held by the suction element 3 to a point at which the travel direction of the winding sleeve 2 driven by a friction wheel 20 coincides with the travel direction of the supply thread 1. This point is at a quadrant of the winding sleeve 2 upstream in the direction of rotation D of the winding sleeve. The plane of the axes of the friction roller 10 and the winding sleeve 2 is represented at P1 and a plane perpendicular thereto at the point or line of contact C of the friction roller 10 with the winding sleeve 2 is represented at P2.

Figure 4:
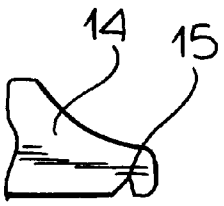
FIG. 4 is an enlarged detail of the portion IV in FIG. 3.
Figure 3:
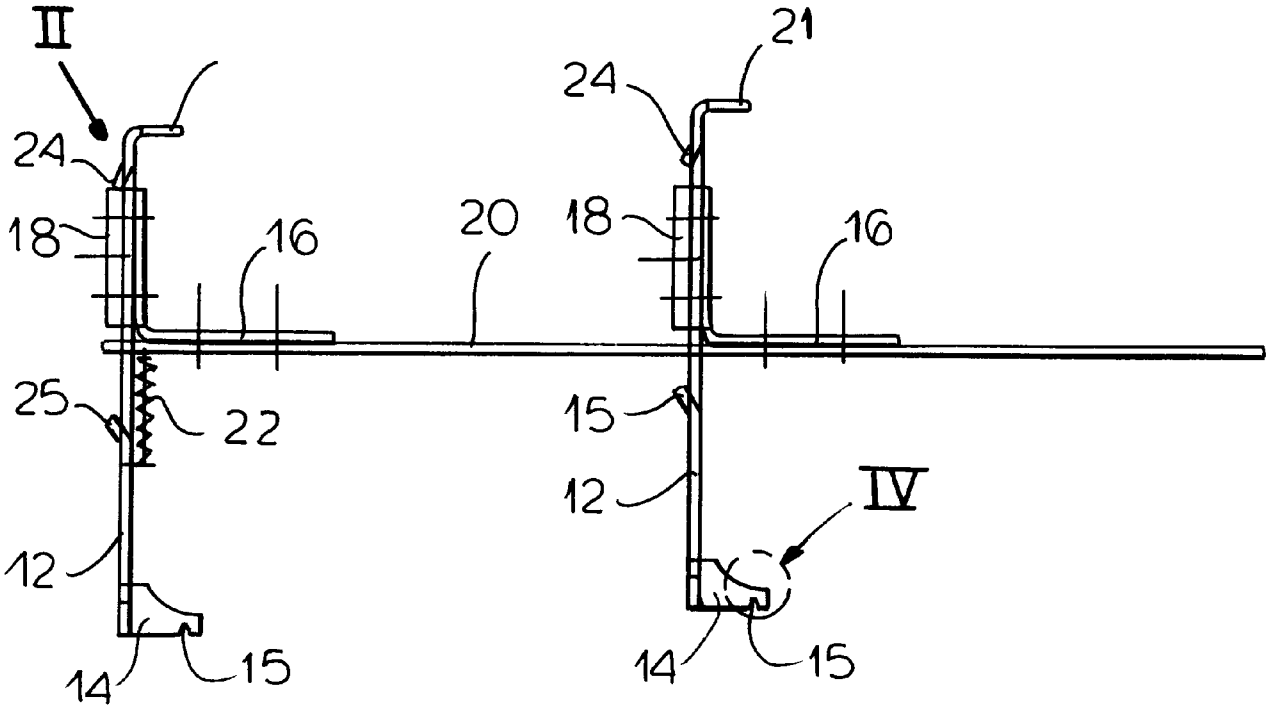
FIG. 3 is a front view of the device for a twin spool winding system.
Figure 5:
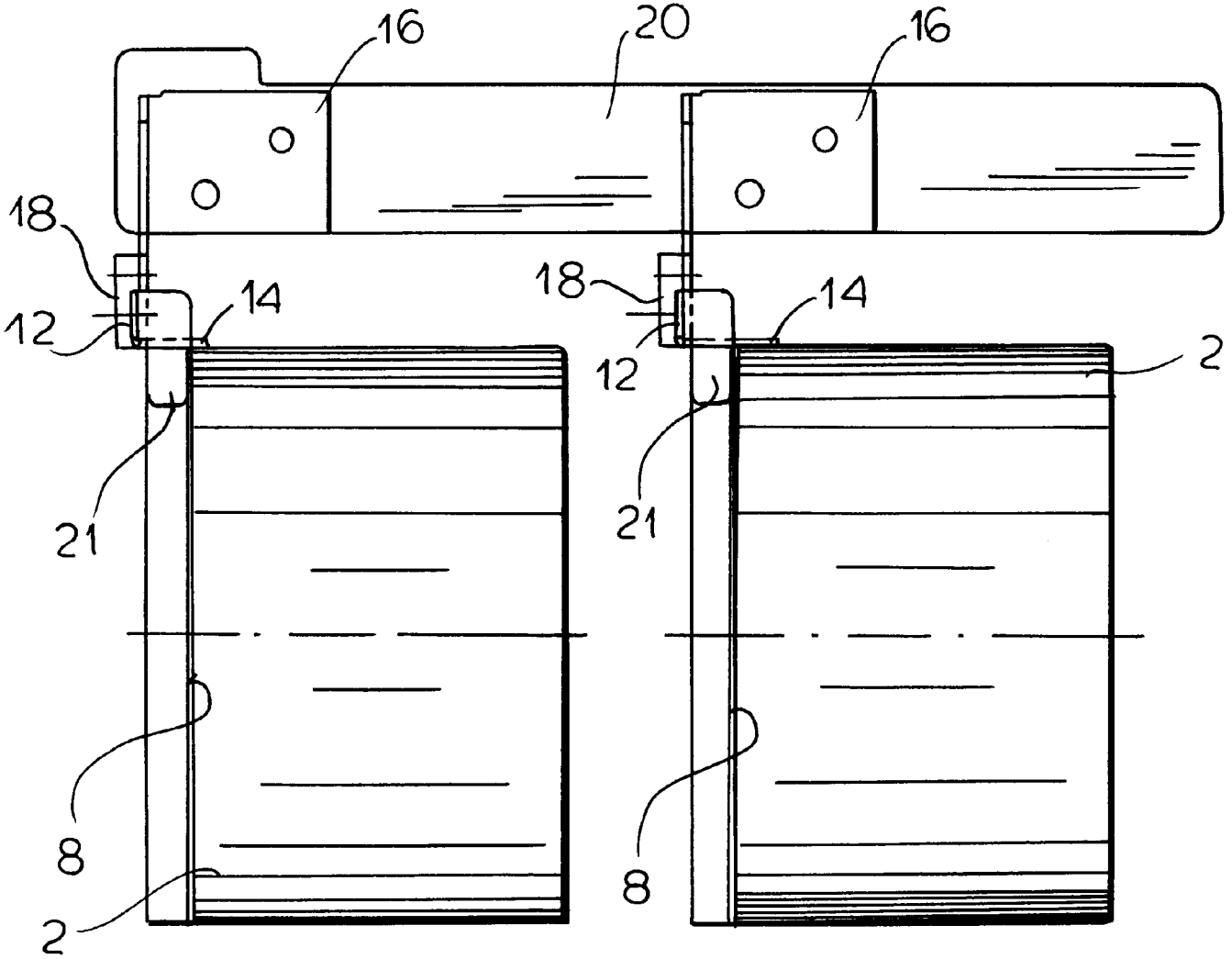
FIG. 5 is a plan view of the device of FIG. 3.

As can be especially seen from FIGS. 3, 4 and 5, the thread guide element is formed from sheet metal and has the configuration of a thread-guide plate 12 which, at its lower end and in the region in which it engages the thread, is formed with a plate 14 having a thread-entraining notch 15.

As can be seen from FIGS. 3 and 5, the thread-guide plate 12 is displaceable within a plate 18 connected to a respective bracket 16 which is affixed to a rail 20 secured to a cross-winding box 17 which contains the mechanism for cross winding the thread onto the respective winding sleeve 2 at each of the stations, two of which have been shown in FIGS. 3 and 5. The thread-guide plate 12 is provided with abutments 24 and 25 which are engageable with the guide 18 to define the limiting positions of the thread-guide plate 12.

Figure 2B:
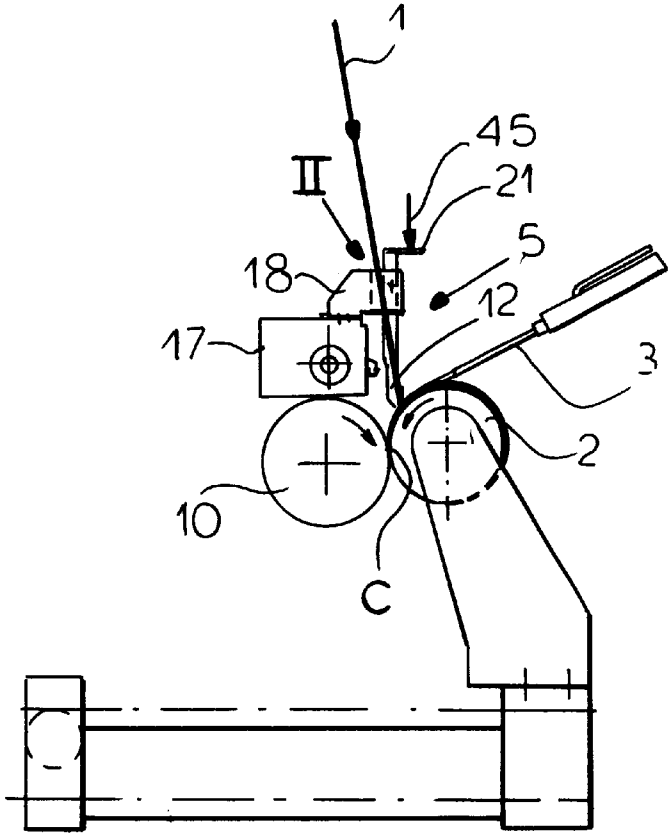
FIGS. 2*a*–2*d* are diagrams showing the sequence of operations in the application of a thread to a winding sleeve according to the invention.
Figure 2A:
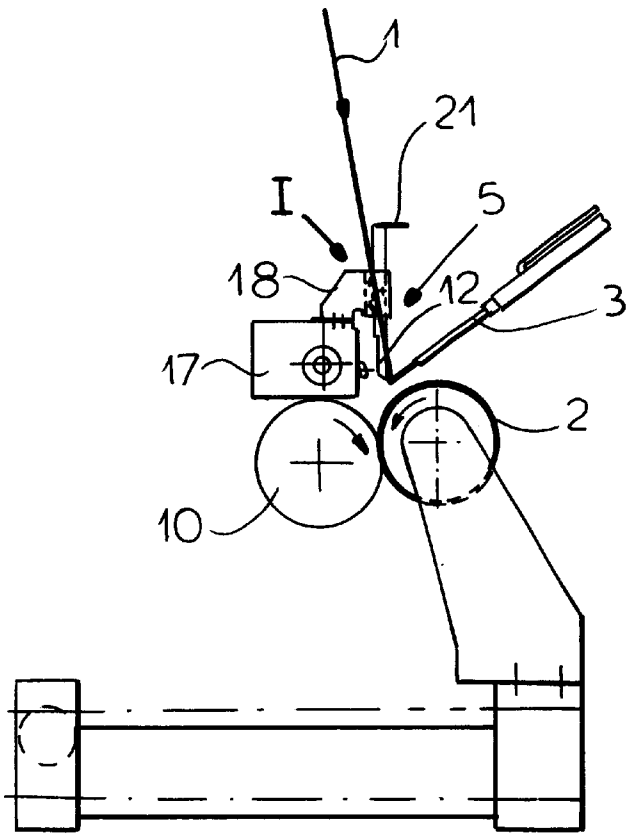

In one of these limiting positions, namely the rest position I shown in FIG. 2*a*, the thread guide 5 engages the thread 1 as it is held by the suction element 13 which brings the thread into engagement with the notch 15, at a location spaced from and remote from the winding sleeve 2.

The thread-guide member 15 has an actuating part 21 which is displaceable by an appropriate actuator represented by the arrow 45 for displacing the thread guide into its working position II (FIG. 2*b*). For returning the thread-guide plate 12 from its working position II into its rest position, a restoring element in the form of a spring 22 can be provided as best shown in FIG. 3.

Once the thread 1 has been engaged in the notch 15 of the plate 14 in the rest position I (FIG. 2*a*), a pressing force is applied at 45 (FIG. 2*b*) either manually by a suitable effector, to displace the thread-guide member 12 from its rest position I into the working position II and to entrain the thread 1, while it is still held by the suction element 3 to the groove 8 of the sleeve 2. This point of contact of the thread with the sleeve is in the quadrant immediately ahead of the contact line C and the thread at this point lies approximately in the plane P2.

Figure 2C:
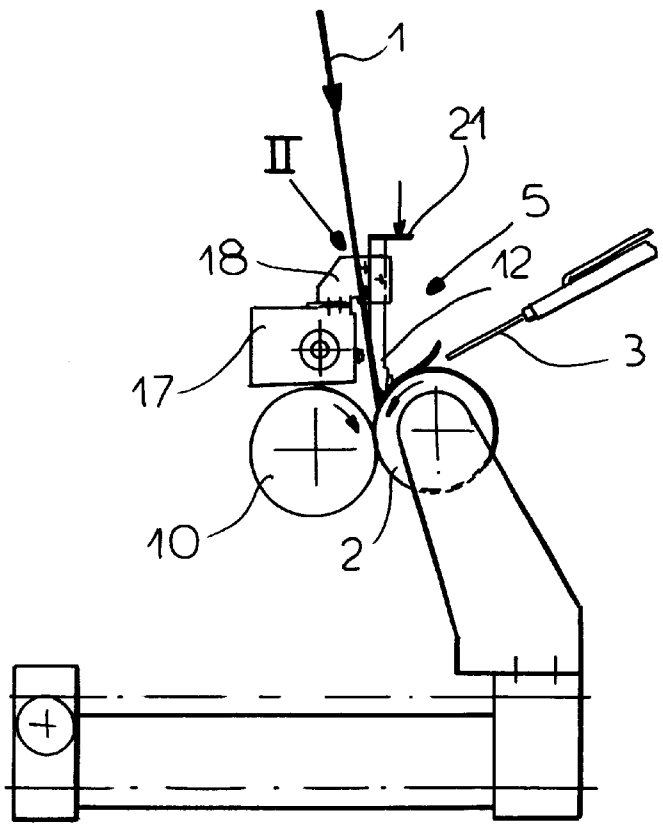

Once the thread 1 is engaged by the winding sleeve (FIG. 2*c*), the thread end is torn out of the suction element 3 with the thread tension reduced at this point to a minimum value.

Figure 2D:
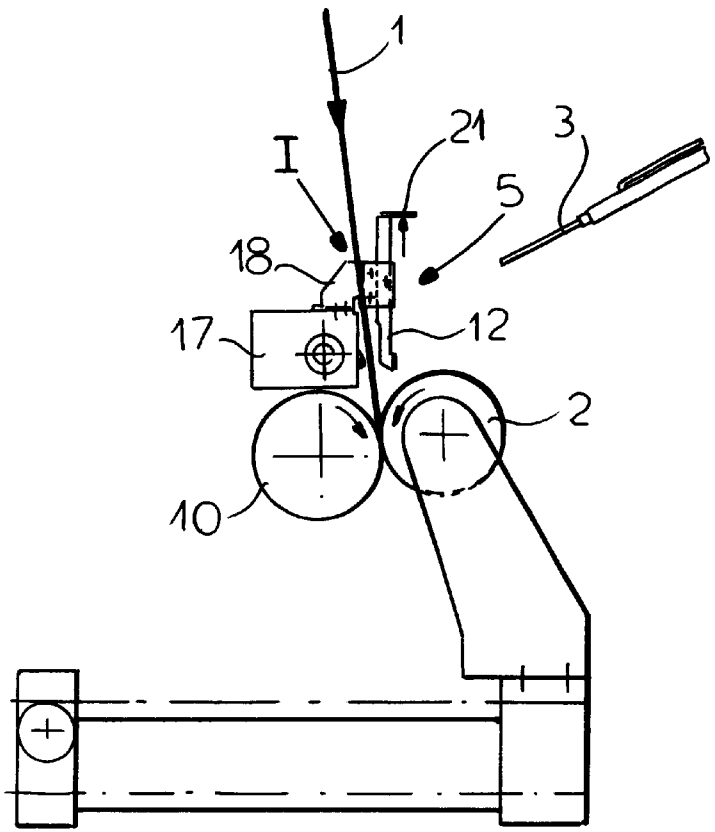

With the aid of the restoring spring 22 the thread-guide plate 12 is returned to its rest position (FIG. 2*d*) and the thread 1 is wound on the winding sleeve 2, preferably in a cross winding, i.e. a winding in which the turns of successive layers are pitched in opposite directions.

From FIGS. 3 and 5 it will be apparent that two or more thread-guide units 5 can be spaced apart along the rail 20 and the thread-guide plate 12 at the left-hand side is shown in its working position in which the abutment 24 engages the guide 18. The thread-guide plate 12 at the right-hand side is shown without a spring 22 and in an intermediate position in which the abutment 24 and 25 are not functioning.

The thread-guide plate 12 can be formed as one piece with corresponding bends and cut-outs for the actuating part 21, the abutments 24 and 25 and the plate 14 with its notch 15.

The device of the invention which can be manually or automatically operated is thus relatively simple and can place the thread 1 in the thread-guide slit 8 at a location in which the travel directions of the winding sleeve 2 and the thread 1 coincide.

I claim:

1. A method of applying a thread to a winding sleeve having a thread-capturing slit in the periphery thereof and wherein a friction roller contacts said winding sleeve along a contact line to rotate said winding sleeve and wind up said thread thereon to form a spool, said method comprising the steps of:

(a) supplying said thread to said winding sleeve from a location such that said thread, in winding onto said sleeve, lies approximately in a plane substantially tangential to said friction roller and said winding sleeve at said contact line;

(b) holding a free end of the thread with a suction element to form a span of said thread between said location and said suction element; and (c) entraining the thread along said span with a thread-guide element to said thread-capturing slit of said winding sleeve at a quadrant thereof immediately ahead of said contact line in the rotation of said winding sleeve, thereby capturing said thread on said winding sleeve and withdrawing said end from said suction element.

2. The method defined in claim 1, further comprising upon engagement of said thread by said suction element, passing said thread through said thread-guide element in a starting position of said thread-guide element spaced from said winding sleeve, and then moving said thread-guide element from said starting position toward said winding sleeve.

3. The method defined in claim 2, further comprising moving said thread, after capture of said thread in said slit of said winding sleeve, back to said starting position.

4. An apparatus for applying a thread to a winding sleeve having a thread-capturing slit in the periphery thereof and wherein a friction roller contacts said winding sleeve along a contact line to rotate said winding sleeve and wind up said thread thereon to form a spool, said-apparatus comprising:

means for supplying said thread to said winding sleeve from a location such that said thread, in winding onto said sleeve, lies approximately in a plane substantially tangential to said friction roller and said winding sleeve at said contact line;

a suction element for holding a free end of the thread to form a span of said thread between said location and said suction element; and a thread-guide element movable from a starting position for entraining the thread along said span to said thread-capturing slit of said winding sleeve at a quadrant thereof immediately ahead of said contact line in the rotation of said winding sleeve, thereby capturing said thread on said winding sleeve and withdrawing said end from said suction element.

5. The apparatus defined in claim 4 wherein said thread-guide element is a sheet-metal member formed with a notch in which said thread is engaged.

6. The apparatus defined in claim 5 wherein said sheet-metal member is guided in a sheet-metal bracket secured to a support.

7. The apparatus defined in claim 6 wherein said apparatus further includes a cross-winding box for said winding sleeves, said support being a rail mounted on said cross-winding box.

8. The apparatus defined in claim 7 wherein a multiplicity of said thread-guide elements provided and said thread-guide elements are mounted on said rail for cooperation with a multiplicity of respective winding sleeves in a multi-spool winder.

9. The apparatus defined in claim 4, further comprising guide means for guiding said thread-guide element for vertical movement between said starting position and said quadrant.

10. The apparatus defined in claim 9, further comprising a restoring element for returning said thread-guide element to said starting position.

11. The apparatus defined in claim 10 wherein said restoring element is a spring.

12. The apparatus defined in claim 9, further comprising respective abutments on said thread-guide element for stopping said thread-guide element at said starting position and at said quadrant.

* * * * *